United States Patent [19]

Hanlon

[11] Patent Number: 4,776,823

[45] Date of Patent: Oct. 11, 1988

[54] CONVERTIBLE TOY FIGURE

[75] Inventor: Barbara J. Hanlon, Baldwin, Md.

[73] Assignee: Monarch Toy Company, Ltd., Baltimore, Md.

[21] Appl. No.: 32,350

[22] Filed: Mar. 31, 1987

[51] Int. Cl.[4] ..... A63H 3/12; A63H 3/02

[52] U.S. Cl. ..... 446/321; 446/371; 446/372

[58] Field of Search ..... 446/100, 321, 337, 339, 446/371, 372, 391, 395, 99, 423, 476

[56] References Cited

U.S. PATENT DOCUMENTS

| | | | |
|---|---|---|---|
| 3,811,220 | 5/1974 | Glass et al. | 446/321 |
| 4,573,927 | 3/1986 | Newman . | |
| 4,614,505 | 9/1986 | Schneider et al. | 446/321 |
| 4,654,019 | 3/1987 | Waggener | 446/321 |
| 4,695,264 | 9/1987 | McLeod, Jr. | 446/321 |

*Primary Examiner*—Robert A. Hafer
*Assistant Examiner*—Charles H. Harris
*Attorney, Agent, or Firm*—Larson and Taylor

[57] ABSTRACT

A convertible toy figure provided with a head having a face with interchangeable expressive mouths is disclosed. The face includes a first panel with an expressive mouth and nose thereon. The first panel is hingedly attached to the head along a border portion of the first panel above the nose. A second panel is also provided with a front including an expressive mouth and nose. The second panel is hingedly attached along a border portion thereof below the mouth to a portion of the border below the mounth of the first panel. The head also includes a pocket located beneath the first panel. The first panel is suitably held in place when the second panel is located in the pocket and the first panel is also suitably held in place when the second is removed from the pocket and is located over the top of the first panel. Preferably, the second panel is held on the first panel by a resilient band located around the border thereof and the first panel is held in place by suitable separable holder members.

15 Claims, 1 Drawing Sheet

CONVERTIBLE TOY FIGURE

FIELD OF THE INVENTION

The present invention relates generally to a convertible toy figure, and more particularly to a toy figure in which an expressive face is convertible.

BACKGROUND OF THE INVENTION

Various convertible toy figures have been disclosed in the prior art. For example, in U.S. Pat. No. 3,811,220 (Glass et al), a rag doll with changeable features includes a plurality of panels with different facial expressions on each panel. As one facial panel is folded down (or up) a new expression appears on the head of the doll. Suitable means are provided for holding the panels in an upper position overlapping the face and in a lower folded down position provided in a pocket in the front torso of the doll.

A doll figure having a means for showing feelings is disclosed in U.S. Pat. No. 4,573,927 (Newman). The doll is provided with individually separable panels having different facial expressions thereon. Each panel can be removed and replaced with another panel as desired. A three dimensional doll having means to fasten various facial features thereon is also disclosed in U.S. Pat. No. 4,122,628 (Crowell et al).

A transformable toy figure which is progressively transformable into different configurations is disclosed in U.S. Pat. No. 4,614,505 (Schneider et al). The figure has a compliant body portion on which a fabric cover, including fanciful facial components and the like, is disposed. A fabric segment is secured to the body portion and forms a pocket on the body portion so that the body portion can be forced into the pocket to progressively change from one configuration to another.

SUMMARY OF THE INVENTION

In accordance with the present invention, a convertible toy figure including a head having a face is provided. The face includes a first panel having a peripheral border on which a first expressive mouth is provided. A first attaching means hingedly attaches the first panel along a first portion of the border to the head. A panel to face holding means is also provided for holding the first panel in position on the head. The head also includes a pocket located beneath the first panel. A second panel on which a second expressive mouth is provided also includes a peripheral border. A second attaching means hingedly attaches the second panel along a portion of the border thereof to a second portion of the border of the first panel. In this manner, the second panel is locatable in the pocket when the first panel is held in position by the first holding means. A second panel holding means is further provided for holding the second panel in front of the first panel when the second panel is removed from the pocket.

Preferably, the second panel is made of a collapsible or compliant material which is easily stuffed into the pocket. In addition, the first panel includes a back, a front on which the expressive mouth is provided, and a stuffing material between this front and back. The second panel holding means then includes a resilient band adjacent the border of the second panel. Thus, the front of the first panel is passed through the band and the resiliency of the band holds the second panel on the first panel.

In the preferred embodiment, the second portion of the border of the first panel to which the portion of the second panel is attached is opposite from the first portion of the border of the first panel. The panel to face holding means then includes opposed separable first and second holding members. The first separable holding member is located on the face adjacent the pocket while the second holding member is located adjacent the portion of the border of the second panel. Thus, when the second panel is located in the pocket, the first and second separable holding members hold to one another and thus hold the first panel in place.

Preferably, the panel to face holding means further includes a third holding member similar to the second holding member. The third holding member is located on a back of the first panel adjacent the portion of the border of the second panel. Thus, the first and third holding members hold to one another and thus hold the first panel in place when the second panel is in front of the first panel.

It is an object of the present invention to provide a toy figure in which the expressions of the toy figure are convertible in an easy and simple manner.

It is also an object of the present invention to provide a means for converting the expressions of the toy figure such that in use the alternate expression not being utilized is hidden from view.

Other features and objects of the present invention are stated in or apparent from a detailed description of a presently preferred embodiment of the invention found hereinbelow.

DETAILED DESCRIPTION OF THE PREFERRED EMBODIMENT

Figure 1:
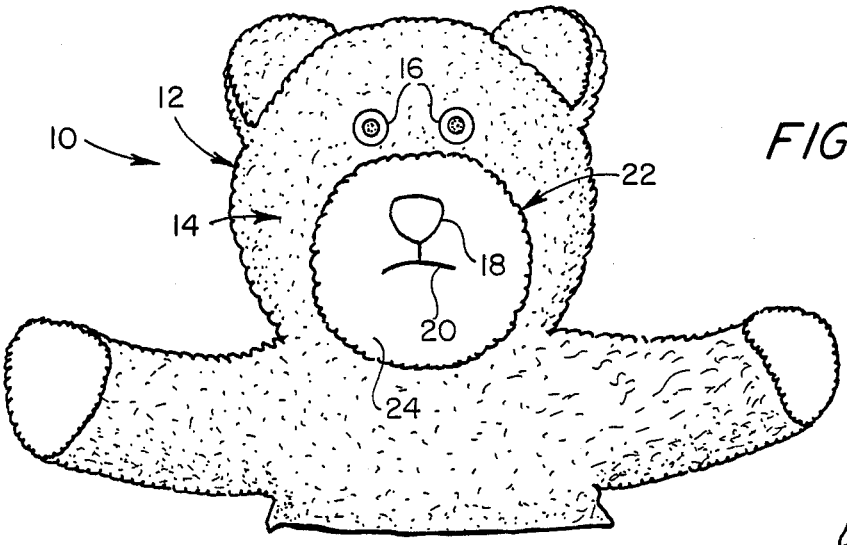
FIG. 1 is a partial front perspective view of the convertible toy figure of the present invention with a first facial expression.

With reference now to the drawings in which like numerals represent like elements, a convertible toy figure 10 according to the present invention is depicted in FIG. 1. Toy figure 10 is depicted as a three dimensional teddy bear made from a suitable fur-covered fabric, although it should be appreciated that various animal or human figures can be used with the present invention. Toy figure 10 includes a head 12 having a face 14. Face 14 is comprised of two eyes 16, a nose 18, and an expressive mouth 20 which is expressing a frown or unhappiness.

Figure 2:
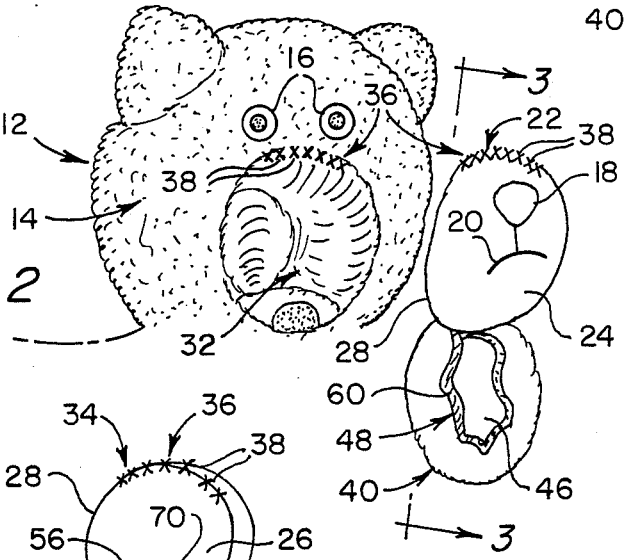
FIG. 2 is a front exploded view of the head of the toy figure depicted in FIG. 1.
Figure 4:
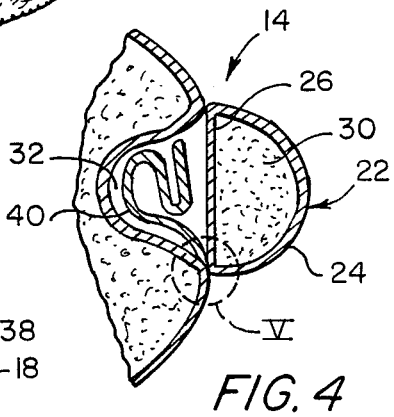
FIG. 4 is a right side cross sectional view of the face portion depicted in FIG. 1.

As shown best in FIG. 2, both nose 18 and mouth 20 are located on a first panel 22 which in this teddy bear embodiment of toy Figure 10 is of a different color than the remainder of head 12. As shown best in FIGS. 2–4, first panel 22 includes a front 24 formed from a fur-covered fabric, a back 26, and a peripheral border 28. In order to have first panel 22 protrude away from head 12, front 24 is suitably shaped and a stuffing material 30 is located between front 24 and back 26.

Head 12 also includes a pocket 32 formed therein beneath the location of first panel 22. First panel 22 is then preferably attached along a first portion 34 of border 28 to head 12 by a suitable first attaching means 36. Preferably, first attaching means 36 is a series of stitches 38 between a portion of pocket 32 adjacent eyes 16 and first portion 34 of border 28. Thus, first panel 22 is hingedly attached to head 12 along stitches 38.

Figure 3:
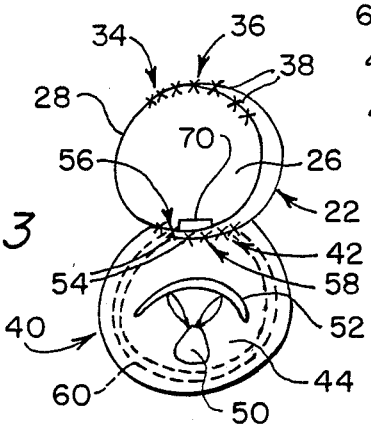
FIG. 3 is rear perspective view of the facial expression panels depicted in FIG. 2.
Figure 6:
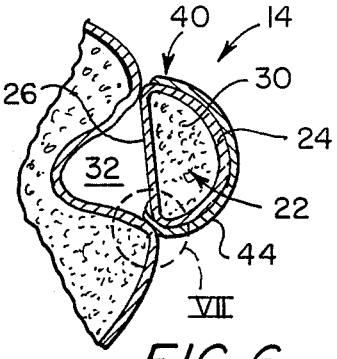
FIG. 6 is a right side cros sectional view of the face portion with a different expressive panel on the front thereof.
Figure 5:
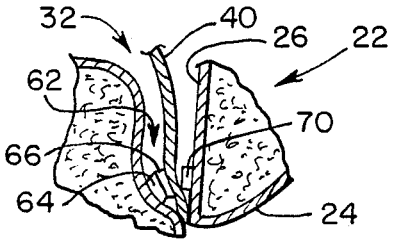
FIG. 5 is an enlarged view of the connection portion depicted in FIG. 4 as indicated by the dotted line V in figure 4.

Toy figure 10 also includes a second panel 40 which is hingedly attached to first panel 22 by a second attaching means 42. As shown, second panel 40 is essentially a single piece of fabric with fur on one side which includes a front 44, a back 46 and a peripheral border 48. Attached to front 44 is a nose 50 and a mouth 52 which expresses a smile (mouth 52 depicted in FIG. 3 is upside down, ready to be pivoted to the correct orientation).

Second panel 40 is preferably formed of a collapsible or compliant material with front 44 having substantially the same appearance (except for the expression of mouth 2) as first panel 22. Second attaching means 42 is preferably in the form of stitches 54 which hingedly attach a second portion 56 of border 28 of first panel 22 (located beneath mouth 20 and opposite first portion 34) to a portion 58 of border 48 of second panel 40 located adjacent mouth 52. Around the remaining portion of border 48, second panel also includes a second panel holding means in the form of a resilient band 60.

In order to hold first panel 22 in position on face 14 when second panel 40 is located in pocket 32, a panel to face holding means 62 is provided. Holding means 62 includes opposed first and second separable holding members 64 and 66, respectively. Conveniently, holding members 64 and 66 are made of VELCRO fastening members, one of which is fibrous and the other of which includes J hooks, which fasteners are well known to those of ordinary skill in the art. Preferably, first holding member 64 is located just inside pocket 32 on the opposite side of pocket 32 from stitches 38. Second holding member 66 is then located on back 46 of second panel 40 immediately adjacent stitches 54. Thus, when second panel 40 is collapsed within pocket 32, second holding member 66 contacts first holding members 64 which thus holds second portion 56 of border 28 of first panel 22 in place. The opposite side of border 28, first portion 28, is held in place to head 12 by stitches 38. Thus, first panel 22 is securely held in place when holding members 64 and 66 engage.

Figure 7:
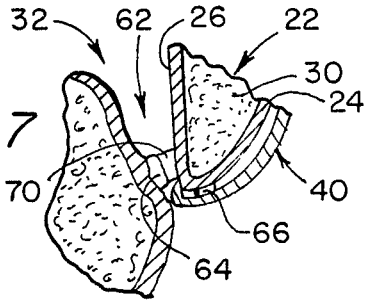
FIG. 7 is an enlarged view of the connective portion depicted in FIG. 6 as indicated by the dotted line VII in FIG. 6.

In order to hold first panel 22 in place when second panel 40 is located in front of first panel 22, panel to face holding means 62 makes use of first holding member 64 as well as third holding member 70 having the same form as second holding member 66 (which is now located between front 24 of first panel 22 and back 46 of second panel 40). Third holding member 70 is located immediately adjacent stitches 54 on back 26 of first panel 22. As shown in FIG. 7, when second panel 40 is in front of first panel 22, third holding member 70 is located opposite first holding member 64. This holds this side of first panel 22 securely in place when second panel 40 is attached in front of first panel 22.

In operation, toy figure 10 functions in the following manner. Initially, where face 14 is in the position depicted in FIGS. 1 and 4, mouth 20 on first panel 22 is visible to the user. In this embodiment, mouth 22 indicates a frown or other unhappy expression. As mentioned above, first panel 22 is pivotable about stitches 38 and is held in place against pivoting by panel to face holding means 62 at this time. When the user decides to change the frown of mouth 20 to a smile such as contained on mouth 52 of second panel 40, first holding member 64 is separated from second holding member 66 simply by pulling holding members 64 and 66 apart. This cause first panel 22 to pivot about stitches 38 away from pocket 32. Then, second panel 40 is removed from pocket 42 and rotated about stitches 54 in front of front 24 of first panel 22. Front 24 is then passed through resilient band 60 surrounding border 48 of second panel 40. Second panel 40 is substantially cup-shaped in order to receive first panel 22 therein and resilient band 60 then resiliently holds second panel 40 on first panel 22 with smiling mouth 52 visible to the user. Third holding member 70 on back 26 of first panel 22 is then engaged with first holding member 64 by pivoting first panel 22 about stitches 38. When it is again desired to have first panel 22 with mouth 20 visible, the reverse of the process described above is performed and second panel 40 is stuffed back into pocket 32.

It should be appreciated that in use when the respective holding members are engaged, both pocket 32 and holding members 64, 66, and 70 are hidden from the view of the user. Thus, the esthetic appearance of toy figure 10 is not affected even though the expression of face 14 is easily changed.

Although the present invention has been described with respect to an exemplary embodiment thereof, it will be understood by those of ordinary skill in the art that variations and modifications can be effected within the scope and spirit of the invention.

I claim:

1. A convertible toy figure comprising:

a head having a face, said face including a first panel having a peripheral border and on which a first expressive mouth is provided;

a first attaching means for hingedly attaching said first panel along a first portion of said border to said head;

a first panel to face holding means for holding said first panel in position on said head;

a pocket in said head located beneath said first panel;

a second panel on which a second expressive mouth is provided, said second panel having a peripheral border;

a second attaching means for hingedly attaching said second panel along a portion of said border thereof to a second portion of said border of said first panel separate from said first portion such that said second panel is locatable in said pocket when said first panel is held in position by said first holding means; and a second panel holding means for holding said second panel in front of said first panel when said second panel is removed from said pocket.

2. A convertible toy figure as claimed in claim 1 wherein said second panel is made of a collapsible material which is easily stuffed into said pocket.

3. A convertible toy figure as claimed in claim 1 wherein said first panel includes a back, a front on which the expressive mouth is provided, and a stuffing material between said front and said back; and wherein said second panel holding means includes a resilient band adjacent to said border of said second panel whereby said front of said first panel is passed through said band and the resiliency of said band holds said second panel on said first panel.

4. A convertible toy figure as claimed in claim 1 wherein said second portion of the border of said first panel to which said portion of said second panel is attached is on an opposite side from said first portion of said border of said first panel.

5. A convertible toy figure as claimed in claim 4 wherein said panel to face holding means includes opposed separable first and second holding members, said first separable holding member being located on said face adjacent to said pocket and said second separable holding member being located adjacent to the portion of the border of said second panel whereby when said second panel is located in said pocket said first and second separable holding members hold to one another to thus hold said first panel to said face.

6. A convertible toy figure as claimed in claim 5 wherein said panel to face holding means includes a third holding member similar to said second holding member, said third holding member being located on a back of said first panel adjacent to the portion of the border of said second panel whereby said first and third holding members hold to one another to thus hold said first panel in place when said second panel is in front of said first panel.

7. A convertible toy figure as claimed in claim 6 wherein said second panel is made of collapsible material which is easily stuffed into said pocket.

8. A convertible toy figure as claimed in claim 7 wherein said first panel includes a back, a front on which the expressive mouth is provided, and a stuffing material between said front and said back; and wherein said second panel holding means includes a resilient band adjacent to said border of said second panel whereby said front of said first panel is passed through said band and the resiliency of said band holds said second panel on said first panel.

9. A convertible toy figure comprising:

a head having a face, said face including a first panel having a front on which an expressive mouth and a nose are located, a back, a peripheral border joining said front and said back, and a stuffing material between said front and said back;

a first attaching means for hingedly attaching said first panel to said head along a portion of said border above the nose;

a second panel having a peripheral border, said second panel including a front with an expressive mouth and a nose;

a second attaching means for hingedly attaching a portion of said peripheral border below the mouth of said second panel to a portion of the border below the mouth of said first panel;

a pocket in said head located beneath said first panel;

a first panel to face holding means for holding said first panel securely in position on said head when said second panel is in said pocket; and a second panel holding means for holding said second panel in front of said first panel when said second panel is removed from said pocket.

10. A convertible toy figure as claimed in claim 9 wherein said second panel is made of a collapsible material which is easily stuffed into said pocket; and wherein said second panel holding means includes a resilient band adjacent said border of said second panel whereby said front of said first panel is passed through said band and the resiliency of said band holds said second panel on said first panel.

11. A convertible toy figure as claimed in claim 10 wherein said panel to face holding means includes opposed separable first and second holding members, said first holding member being located on said face adjacent to said pocket and said second holding member being located adjacent to the portion of the border of said second panel below the mouth whereby when said second panel is located in said pocket said first and second holding members hold to one another; and wherein said panel to face holding means further includes a third holding member similar to said second holding member, said third holding member being located on the back of said first panel adjacent to the portion of the border below the mouth whereby said first and third holding members hold to one another to thus hold said first panel in place when said second panel is in front of said first panel.

12. A convertible toy figure comprising:

a head having a face, said face including a first panel having a planar back, a protruding front on which a first expressive mouth is provided, and a peripheral border joining said front and said back;

a first attaching means for hingedly attaching said first panel along a first portion of said border to said head;

a first panel to face holding means on an opposite side from said first portion of said first panel for holding a second portion of said border to said first portion to said head;

a pocket in said head located beneath said first panel;

a second panel which is cup-shaped and having a front on which a second expressive mouth is provided, said second panel being made of a collapsible material and including a peripheral border;

a second attaching means for hingedly attaching said second panel along a portion of said border thereof to the second portion of said border of said first panel such that said second panel is locatable in said pocket when said first panel is held in position by said first holding means;

a second panel holding means for holding said second cup-shaped panel in front of said protruding front of said first panel when said second panel is removed from said pocket.

13. A convertible toy figure as claimed in claim 12 wherein said second panel holding means includes a resilient band adjacent said border of said second panel whereby said protruding front of said first panel is inserted in said second cup-shaped panel and said resilient band holds said second panel on said protruding front.

14. A convertible toy figure as claimed in claim 13 wherein said panel to face holding means includes opposed separable first and second holding members, said first separable holding member being located on said face adjacent to said pocket and said second separable holding member being located adjacent to the portion of the border of said second panel whereby when said second panel is located in said pocket said first and second separable holding member hold to one another to thus hold said first panel in place.

15. A convertible toy figure as claimed in claim 14 wherein said panel to face holding means includes a third holding member similar to said second holding member said third holding member being located on a back of said first panel adjacent to the portion of the border of said second panel whereby said first and third holding members hold to one another to thus hold said first panel in place when said second panel is in front of said first panel.

* * * * *